US005783980A

United States Patent [19]

Blair et al.

[11] Patent Number: 5,783,980

[45] Date of Patent: Jul. 21, 1998

[54] CERAMIC FILTER WITH NOTCH CONFIGURATION

[75] Inventors: Raymond G. Blair; Patrick E. Lopez, both of Albuquerque, N. Mex.

[73] Assignee: Motorola Inc., Schaumburg, Ill.

[21] Appl. No.: 667,903

[22] Filed: Jun. 20, 1996

[51] Int. Cl.[6] ..... H01P 1/202

[52] U.S. Cl. ..... 333/202; 333/206

[58] Field of Search ..... 333/134, 203, 333/206, 207, 202, 202 DB

[56] References Cited

U.S. PATENT DOCUMENTS 5,177,458 1/1993 Newell et al. ..... 333/206

5,327,109 7/1994 Hoang et al. ..... 333/206

5,512,866 4/1996 Vangala et al. ..... 333/134

FOREIGN PATENT DOCUMENTS 6303007 10/1997 Japan ..... 333/206

*Primary Examiner*—Benny Lee

*Attorney, Agent, or Firm*—Gary J. Cunningham; Colin M. Raufer

[57] ABSTRACT

A ceramic filter (200), having: a filter body; and wrap-around input-output pads (210) with a metallized notch (218) connecting different planes of the wrap-around input-output pads (210). In a preferred embodiment, additional notches (238,240) can be included to minimize the possibility of disconnects on other adjacent surfaces of the ceramic filter (200).

12 Claims, 3 Drawing Sheets

CERAMIC FILTER WITH NOTCH CONFIGURATION

FIELD OF THE INVENTION

This invention relates to ceramic filters having metallized surfaces and, in particular, to ceramic filters with a notch configuration.

BACKGROUND OF THE INVENTION

The use of dielectric ceramic blocks to filter electrical signals is well known in the art. It is also well known that these ceramic blocks are often coated with an electrically conductive material in order to achieve desirable electrical results. The conductive material coating, which can be applied by a variety of processing techniques, forms a metallization coating layer on the surfaces of the ceramic material which serves to provide an electrical ground or a predetermined capacitive coupling for the filter.

Typically, the metallization layer will be deposited in a predetermined pattern on specific regions of the filter. Other regions of the filter will be completely covered with a metallization coating. For example, a top surface of a ceramic filter block may be metallized with an electrode pattern and corresponding side surfaces of the ceramic filter block may be entirely coated with the conductive material metallization coating in order to create a ground plane.

During processing, the metallization coating may be applied to the surface of the ceramic filter using a variety of different deposition techniques. The metallization coating may be applied during screen printing, dipping, spraying, brushing, or during other steps in the filter manufacturing process. There are often processing steps that may be unique to the manufacture of a specific type of filter. For example, one surface of a filter may be coated at one stage of the filter manufacturing process and other surfaces may be coated during subsequent processing steps. Often times, a conductive coating may be applied at one stage in the filter manufacturing process and that conductive coating may later be removed by use of a chemical solvent or other similar process.

Although the exact processes used to create the metallization coating may vary, as a general rule, all metallized coatings will eventually be joined to the surface of the ceramic during a high temperature firing operation. During this firing operation, some metallized surfaces must become electrically connected to the other metallized surfaces of the ceramic block filter in order to achieve desired electrical properties.

Problems may arise during manufacturing when the metallization coating or electroding which is applied to multiple surfaces is not properly electrically connected. This will typically occur at the interface of two planes of ceramic, and the resulting region where there is not a conductive coating is called a "disconnect" or an "open circuit". Although this problem has existed since the early days of metallized ceramics for electronic applications, the problem has recently been addressed with greater urgency for numerous reasons. First, as the trend in the industry has been toward smaller filter dimensions, "disconnects" or open circuit have begun to actually effect the electrical performance of the filters Whereas previous filters also had regions of "disconnects", the size of these regions relative to the size of the overall filter was very small. As filters have become smaller, the magnitude of this problem continues to increase.

Another factor which has brought the problem of open circuit or "disconnects" to the forefront is the fact that metallization designs and geometries are today actually much more detailed and elaborate than they were in the past. As the fine-line geometries and patterns (which are becoming more prevalent on all surfaces of these ceramic filters) are being designed into next generation filters, precise conductive paths which often are quite narrow and are electrically connected to multiple surfaces of the filter are becoming the norm. Consequently, a "disconnect" which arises on a very narrow conductive interface can prevent that particular conductive path from performing its electrical function.

At an even more fundamental level, as electrical input and output pads (which are typically on a side surface of a ceramic filter block) are decreasing in size, the important electrical paths which connect these pads with the electrical pattern on the top surface of the ceramic filters are becoming sites of "disconnects".

A feature which could be designed into future ceramic block filter which could prevent or minimize the occurances of electrical "disconnects" in the metallization coating, and aid electroding continuity over the interface of two planes (while maintaining the desired electrical properties and performance of the filter), would be considered an improvement in the art.

DETAILED DESCRIPTION OF THE PREFERRED EMBODIMENT

Figure 1:
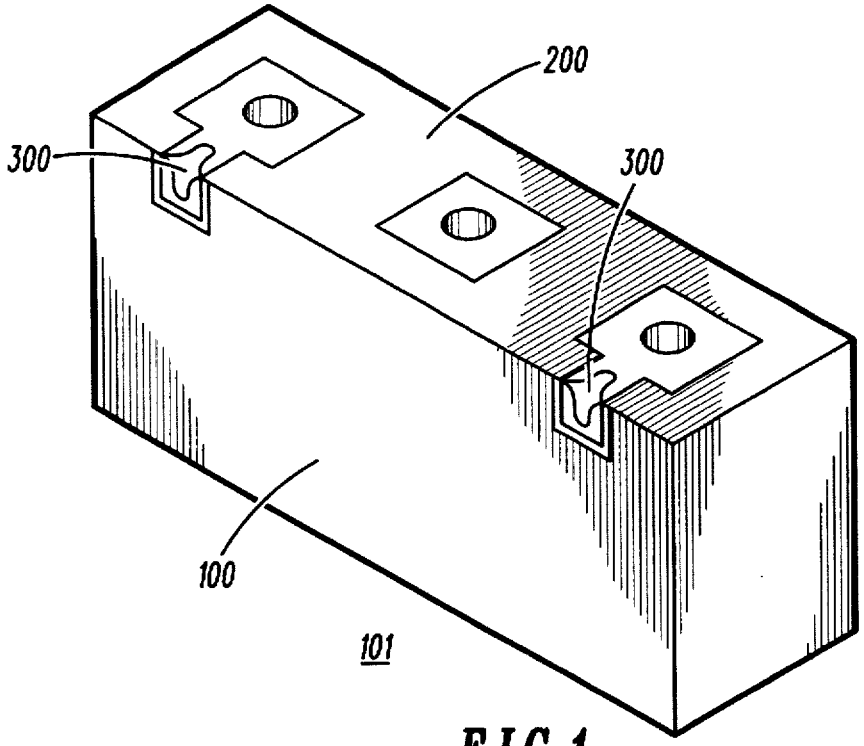
FIG. 1 shows a perspective view of one embodiment of a ceramic filter with notch configuration in accordance with the present invention.

The present invention can best be understood with reference to FIGS. 1–4. FIG. 1 shows a partial perspective view of one embodiment a notch in a dielectric ceramic block filter in accordance with the present invention. More specifically, FIG. 1 shows a ceramic block filter 101 having a first side surface 100 and a second top surface 200 with a notch 300 which aids the electroding continuity over the surface of two planes of surfaces 100 and 200. In this embodiment, the notch is curved in the middle to create a smooth and angled channel adapted to improve the flow of conductive material therein and between the two surfaces. Other embodiments may include notches which are shaped like the letter "V" and meet at a single point in the block. It is important that the notch be sufficiently large so as to direct and accept the flow of metallization material, and sufficiently small so as to maintain the desired electrical performance of the filter. If the notch is too small in area, the metallization will simply not freely flow into this cavity and the application of a conductive metallic material to the surface of the dielectric block filter to provide an electrical ground plane in a process known as "electroding" may not be improved. On the other hand, if too much ceramic material is removed from the ceramic block to form the notch, then the overall electrical performance of the filter may be compromised.

The term notch as used herein includes its normal dictionary meaning, including but not limited to, a V-shaped indentation; a rounded indentation cut on the fore edge of a book; a deep close pass or gap; to cut or make a notch in; to mark or record by a notch; or score or achieve.

Figure 2:
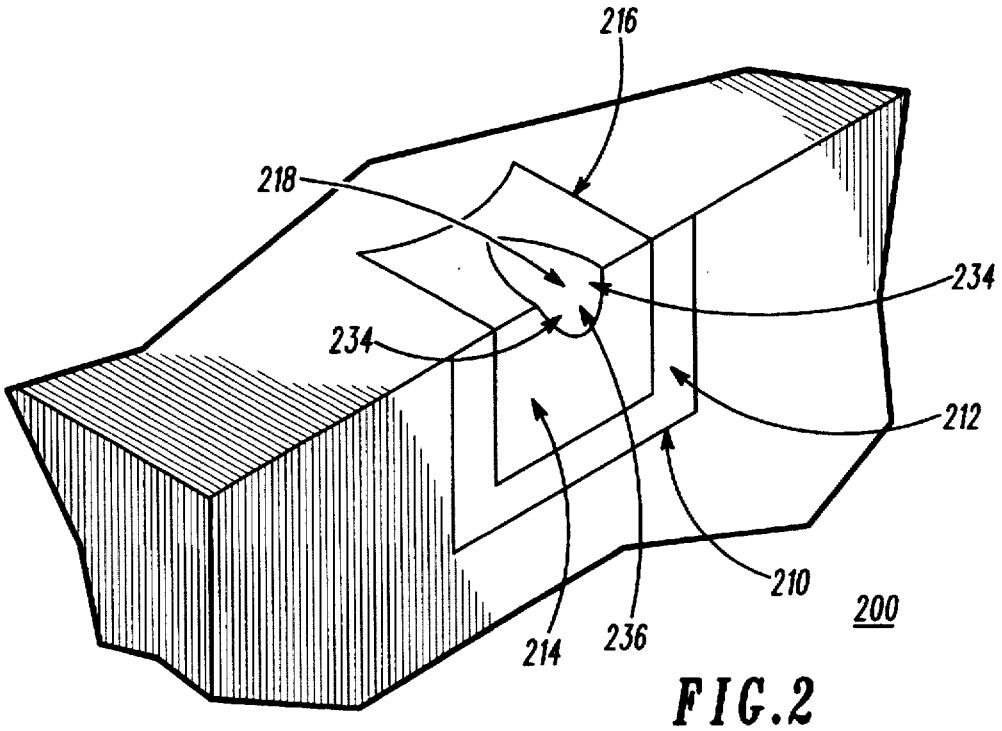
FIG. 2 shows a view of a notch designed in a wraparound input-output pad positioned between a side surface and a metallization pattern on a top surface of a ceramic block filter, in accordance with the present invention.

FIG. 2 shows a view of a notch designed to aid metallization electroding and minimize "disconnects" in (wraparound) input-output pads on a side surface and a metallization pattern on the top surface of a dielectric ceramic block filter, in accordance with the present invention.

As the trend in the industry moves toward smaller filter dimensions, the size of the electrical input-output pads is decreasing in a corresponding manner. As such, the conductive paths which electrically connect into and out of these pads are also decreasing in width. FIG. 2 shows a magnified view of a notch located in such a region. More particularly, in FIG. 2, a partial view of a ceramic block filter 200 is shown, having an electrical input-output pad 210 which includes a metallized region 214 which is surrounded by an unmetallized dielectric region 212. In a preferred embodiment, the metallized region 214 positioned on a side surface, is connected electrically to a metallization pattern 216 on the top surface of the block. In this embodiment, a substantially smooth and rounded notch 218 is inserted (placed) between these two surfaces to aid the electroding over these two surfaces and to minimize the occurance of disconnects. In this drawing, the two surfaces meet at substantially a right angle. However, the notch of the present invention can improve electroding over any two surfaces which are non-planar relative to each other. It is important that the conductive paths on this region of the ceramic filter block remain electrically connected to assure the proper functioning and attainment of the desired characteristics of the filter.

Figure 4:
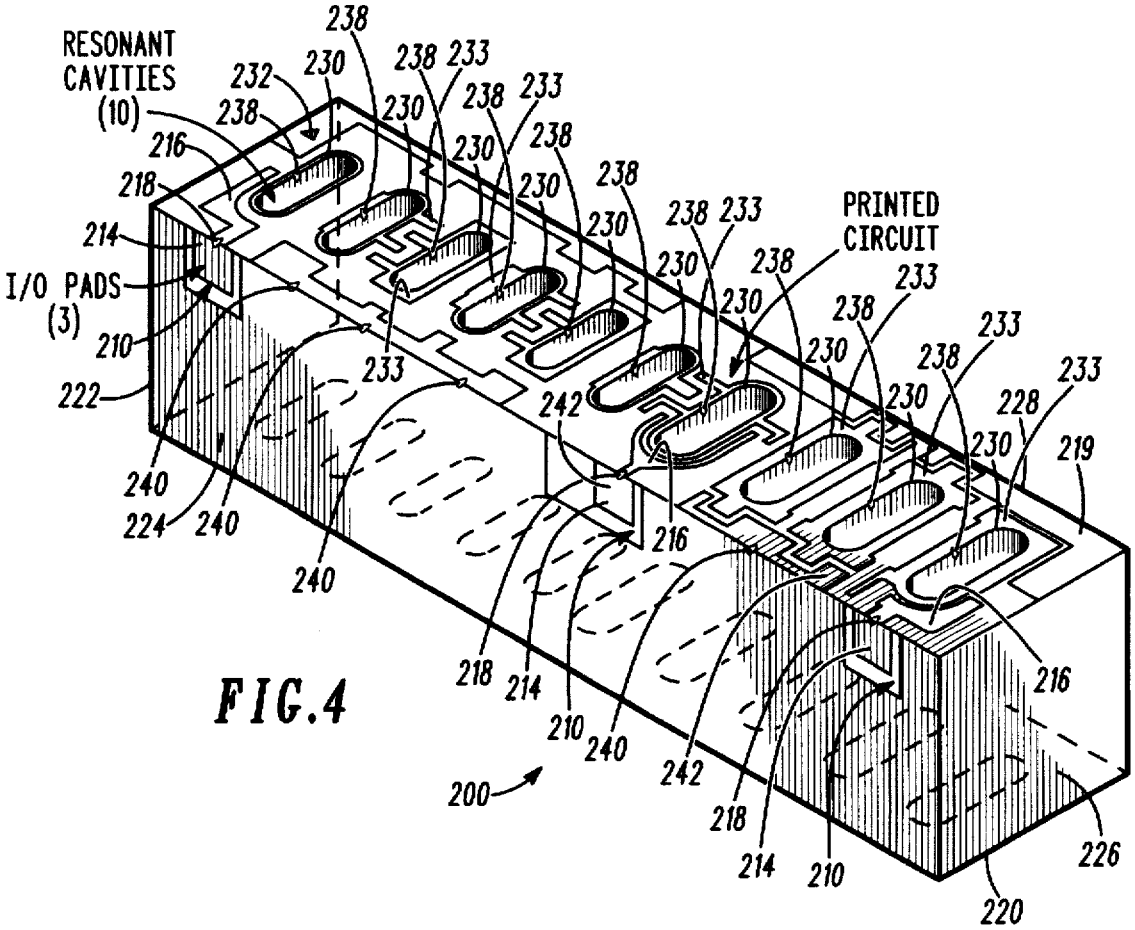
FIG. 4 shows a preferred embodiment of a ceramic filter with notch configuration, in the form of a duplex filter, in accordance with the present invention.

In a preferred embodiment, the notch has two linear side surfaces 234 (in FIG. 2) and a curved and smooth apex 236 therebetween, at an angle of about 45° from the top 219 and side 224 surfaces of FIG. 4 to provide a good electrical connection with minimal chances of disconnects.

Figure 3:
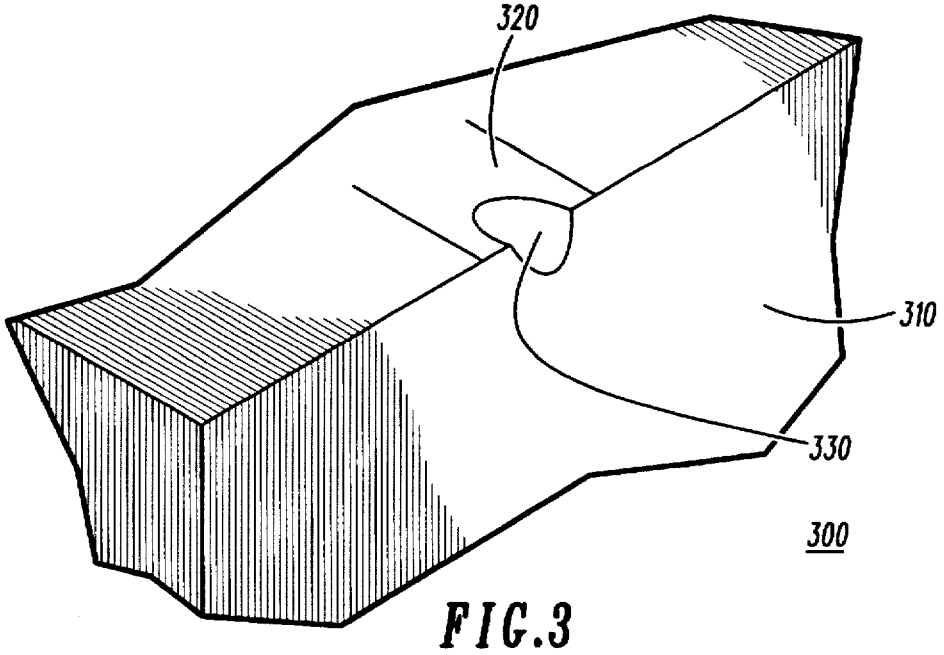
FIG. 3 shows a view of a different notch configuration adapted to aid electroding between a narrow conductive path on a top surface metallization pattern and an electrically grounded side surface of a dielectric ceramic block filter, in accordance with the present invention.

FIG. 3 shows a magnified view of an embodiment of a notch designed to aid electroding between a narrow conductive path on a top surface metallization pattern and an electrically grounded side surface of a dielectric ceramic block filter, in accordance with the present invention. Similar to FIG. 2 above, the notch in this drawing is strategically placed to aid the flow of conductive metallization material and minimize the occurances of disconnects across the interface of two surfaces of a ceramic filter block.

In more detail, in FIG. 3, a ceramic block filter 300 is provided which has an electrically grounded side surface 310 and a narrow conductive metallization path 320 on the top surface of the filter 300. The notch 330 is placed between these two surfaces in order to minimize disconnects and aid electroding across these two surfaces.

As shown in FIG. 3, the notch 330 can be inserted or placed into the block at an angle of about thirty to about sixty degrees from the top surface, preferably at about forty-five degrees for simplified flow of conductive material into the notch 330 to minimize unwanted disconnects. (This structure is also shown and described in connection with notch 240 in FIG. 4.) However, the present invention contemplates inserting the notch at other angles which will increase the flow of conductive material between these surfaces, to minimize the occurance of undesirable disconnects.

In FIG. 4, a ceramic filter, in the form of a duplex filter, is shown as item 200. The filter 200 includes: a filter body comprising a block of dielectric material having a top surface 219, bottom surface 220, and side surfaces 222, 224, 226 and 228, and also having a plurality of metallized through-holes 230 extending from the top surface 219 to the bottom surface 220 defining resonators. The exterior surfaces 220, 222, 224, 226 and 228 are substantially covered with conductive material defining a metallized layer, except for the top surface 219 which includes a desired metallized pattern to provide a desired printed circuit for example. Input-output pads 210 comprise an area of conductive material on at least one of the side surfaces and are at least immediately surrounded by an unmetallized area of non-conductive material. A desired metallized pattern 232 on the top surface 219 includes a pattern connectable to one or more of the metallized side surfaces, for providing a desired frequency response. A notch 218 is provided to connect the metallization coatings, for example, on at least two adjacent surfaces of the (wrap-around) input-output pads 210. In a preferred embodiment, the notch 218 is sufficiently large to so as to direct a flow of metallization therethrough during metallization processing and sufficiently small so as to maintain the desired electrical performance of the filter.

In a preferred embodiment also shown in FIG. 4, are notches 238 attaching a second plurality of top metallization patterns 233 with the metallized through-holes 230 at strategic locations, for improved coupling of the metallization patterns between the through holes and the plurality of second-top metallization pattern 233. Each pattern 233 is positioned on the top surface 219 and adjacent to respective through-holes 230. Also in FIG. 4, three electrical input and output pads (I/O pads in FIG. 4) are provided. Additionally, the duplex filter of FIG. 4 also contains ten resonant cavities (RESONANT CAVITIES in FIG. 4) as well as a printed circuit pattern (PRINTED CIRCUIT in FIG. 4) on the top surface 219 of the duplex ceramic filter 200.

In a preferred embodiment, there can be three categories of notches used in connection with the duplex filter shown in FIG. 4. First, the notches 218 provide a small or portable connection between the metallized region 214 and metallized pattern 216 of the wraparound input-output pads 210. This is an important electrical connection, and as the size of the input-output pads decrease, it becomes increasingly critical to maintain electrically conductive paths in this region, so as to minimize the chances of disconnects and undesirable frequency responses.

Similarly, notches 238 are strategically located between the through-holes 230 (resonant cavities) and the second-top metallized pattern 233 on the top surface 219. Since the internal surface of the through-holes 230 (resonant cavities) are coated with a conductive coating, and they must be electrically connected to certain places on the pattern 233 on the top surface 219, strategic placement of these notches 238 can substantially improve electroding and electrical connections between these two surfaces and patterns, by providing a minimal possibility of disconnects.

Likewise, in a preferred embodiment, a third plurality of notches 240 are strategically placed between a plurality of third printed circuit patterns 242 on the top surface 219 and metallization on the side surface 224. This configuration can aid in the electroding between these two surfaces, for the same reasons articulated above, namely, aiding in the metallization process and minimizing the occurance of undesirable disconnects. As should be understood, notches 238 and 240 can be constructed in a manner substantially similar to the structure discussed with respect to notches 218.

Figure 5:
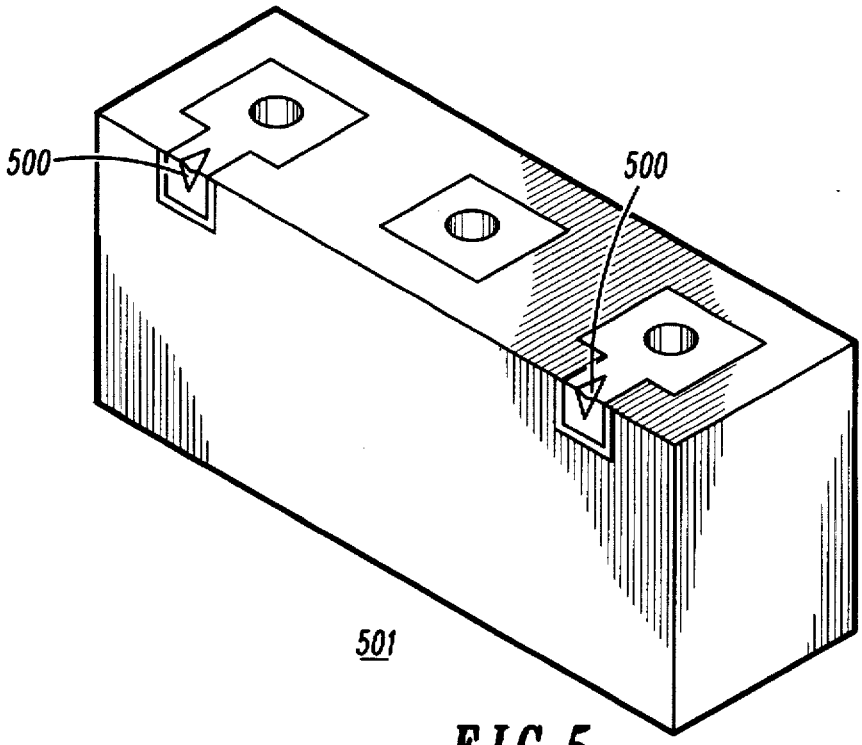
FIG. 5 shows an embodiment of a ceramic filter with a V-notch connecting input-output pads to a printed circuit pattern on the top surface of the filter in accordance with the present invention.

FIG. 5 shows an embodiment of a ceramic filter with a V-notch connecting input-output pads to a printed circuit pattern on the top surface of the filter in accordance with the present invention. Referring to FIG. 5, a ceramic filter 501 is provided which has a V-notch 500 which is substantially V-shaped.

Although various embodiments of this invention have been shown and described, it should be understood that various modifications and substitutions, as well as rearrangements and combinations of the preceding embodiments, can be made by those skilled in the art, without departing from the novel spirit and scope of this invention.

What is claimed is:

1. A ceramic filter, comprising:

a filter body comprising a block of dielectric material and having top, bottom, and side surfaces, and having a plurality of metallized through-holes extending from the top surface to the bottom surface defining respective resonators, the top, bottom, and side surfaces being substantially covered with a conductive material defining a metallized layer with the exception that a portion of the top surface is unmetallized;

conductive wrap-around input-output pads on at least one of the side surfaces and at least immediately surrounded by an unmetallized area of dielectric material which electrically isolate the conductive wrap-around input-output pads from the metallized layer; and the conductive wrap-around input-output pads having an inclined notch with a curved apex defining a metallized radius of curvature which maintains conductive continuity substantially throughout the conductive wrap-around input-output pads.

2. The filter of claim 1, wherein the inclined notch is oriented at an angle of about thirty to about sixty degrees relative to the top surface.

3. The filter of claim 1, wherein the inclined notch comprises two linear surfaces connected by the curved apex.

4. The filter of claim 1, wherein the inclined notch is between the top and the at least one side surface of the dielectric ceramic block filter defining an edge portion at an angle of about 45 degrees from each surface.

5. The filter of claim 1, wherein the filter is in the form of a duplex-filter.

6. A ceramic filter, comprising:

a filter body comprising a block of dielectric material and having top, bottom, and side surfaces, and having a plurality of metallized through-holes extending from the top surface to the bottom surface defining respective resonators, the top, bottom, and side surfaces being substantially covered with a conductive material defining a metallized layer with the exception that a portion of the top surface is unmetallized;

conductive wrap-around input-output pads on at least one of the side surfaces and a top surface and at least immediately surrounded by an unmetallized area of dielectric material which electrically isolate the conductive wrap-around input-output pads from the metallized layer; and the conductive wrap-around input-output pads having an inclined notch which is substantially V-shaped and comprises two linear metallized surfaces which maintain conductive continuity substantially throughout the conductive wrap-around input-output pads.

7. The filter of claim 6, further comprising a plurality of notches connecting at least one of (i) the top surface and at least one of the side surfaces, and (ii) the top surface and at least one of the plurality of metallized through-holes.

8. The filter of claim 6, comprising a further inclined notch connecting a printed pattern on the top surface to the metallization on at least one of the side surfaces.

9. The filter of claim 6, wherein the inclined notch is positioned at an edge where the top surface meets one of the at least one side surfaces at an angle of about 45 degrees relative to the top surface.

10. A ceramic filter, comprising:

a filter body comprising a block of dielectric material and having top, bottom, and side surfaces, and having a plurality of metallized through-holes extending from the top surface to the bottom surface defining respective resonators, the top, bottom, and side surfaces being substantially covered with a conductive material defining a metallized layer with the exception that a portion of the top surface is unmetallized;

conductive wrap-around input-output pads defining a narrow path between the side and top surfaces, and the conductive wrap-around input-output pads at least immediately surrounded by an unmetallized area of dielectric material which electrically isolates the conductive wrap-around input-output pads from the metallized layer; and the conductive wrap-around input-output pads having an inclined notch with a curved apex defining a metallized radius of curvature which maintains conductive continuity substantially throughout the conductive wrap-around input-output pads.

11. The filter of claim 10, wherein the inclined notch is positioned at an edge portion where the top surface meets one of the at least one side surfaces at an angle of about 45 degrees relative to the top surface.

12. The filter of claim 10, comprising a further inclined notch connecting a printed pattern on the top surface to the metallization on at least one of the side surfaces.

* * * * *